US011391061B2

(12) United States Patent
Minnich et al.

(10) Patent No.: US 11,391,061 B2
(45) Date of Patent: Jul. 19, 2022

(54) ELECTROMECHANICAL COMPRESSION LATCH AND LATCHING SYSTEM

(71) Applicant: Southco, Inc., Concordville, PA (US)

(72) Inventors: David Minnich, Lincoln University, PA (US); Christopher Todd Gahring, Jr., Wynnewood, PA (US); Robert Speers, West Chester, PA (US)

(73) Assignee: Southco, Inc., Concordville, PA (US)

( * ) Notice: Subject to any disclaimer, the term of this patent is extended or adjusted under 35 U.S.C. 154(b) by 516 days.

(21) Appl. No.: 15/566,407

(22) PCT Filed: Apr. 15, 2016

(86) PCT No.: PCT/US2016/027671

§ 371 (c)(1),
(2) Date: Oct. 13, 2017

(87) PCT Pub. No.: WO2016/168538

PCT Pub. Date: Oct. 20, 2016

(65) Prior Publication Data

US 2018/0298636 A1 Oct. 18, 2018

Related U.S. Application Data

(60) Provisional application No. 62/148,301, filed on Apr. 16, 2015.

(51) Int. Cl.
*E05B 17/00* (2006.01)
*E05B 47/00* (2006.01)
(Continued)

(52) U.S. Cl.
CPC ..... *E05B 17/0029* (2013.01); *E05B 15/0006* (2013.01); *E05B 17/002* (2013.01);
(Continued)

(58) Field of Classification Search
CPC ..... E05C 5/02; E05C 5/04; Y10T 292/0863; Y10T 292/0864; Y10T 292/0866;
(Continued)

(56) References Cited

U.S. PATENT DOCUMENTS 2,786,701 A * 3/1957 Povlich ..... E05B 77/48 292/144
4,355,830 A 10/1982 Rau, III
(Continued)

FOREIGN PATENT DOCUMENTS

DE 4210084 A1 10/1992
DE 19642457 A1 * 10/1997 ..... E05B 81/20
(Continued)

OTHER PUBLICATIONS

International Search Report and Written Opinion for International Application No. PCT/US2016/027671, dated Jul. 13, 2016—10 Pages.
(Continued)

*Primary Examiner* — Kristina R Fulton
*Assistant Examiner* — James E Ignaczewski
(74) *Attorney, Agent, or Firm* — RatnerPrestia

(57) ABSTRACT

Latch assemblies and systems are disclosed. One latch includes a latch and a receiver. The latch has a housing and a pin extending from the housing. The pin is mounted for longitudinal movement along a pin axis. The latch further includes a motor coupled to move the pin longitudinally. The receiver defines an aperture extending along a receiver axis and positioned to receive the pin of the latch. The receiver has a retainer biased toward the receiver axis. The latch assembly has an open position in which the pin is extended distally along the pin axis and received in the aperture, and a latched position in which the pin is retracted proximally along the pin axis while the retainer is engaged with the pin.
(Continued)

One latch system includes a plurality of latch assemblies configured to move to the latched position after all latch assemblies are in the open position.

16 Claims, 10 Drawing Sheets

(51) Int. Cl.

| | |
|---|---|
| ***E05B 63/12*** | (2006.01) |
| ***E05B 63/14*** | (2006.01) |
| ***E05B 77/34*** | (2014.01) |
| ***E05B 79/20*** | (2014.01) |
| ***E05B 81/20*** | (2014.01) |
| ***E05B 81/40*** | (2014.01) |
| ***E05B 85/02*** | (2014.01) |
| ***E05B 15/00*** | (2006.01) |
| ***E05B 81/06*** | (2014.01) |
| ***E05B 63/24*** | (2006.01) |
| ***E05B 85/22*** | (2014.01) |
| ***E05B 81/90*** | (2014.01) |
| ***E05C 5/02*** | (2006.01) |
| ***E05B 53/00*** | (2006.01) |
| ***E05B 81/66*** | (2014.01) |
| ***E05C 5/04*** | (2006.01) |
| *E05B 47/02* | (2006.01) |

(52) U.S. Cl.
CPC ..... *E05B 47/0012* (2013.01); *E05B 53/003* (2013.01); *E05B 63/125* (2013.01); *E05B 63/143* (2013.01); *E05B 63/24* (2013.01); *E05B 63/244* (2013.01); *E05B 77/34* (2013.01); *E05B 79/20* (2013.01); *E05B 81/06* (2013.01); *E05B 81/20* (2013.01); *E05B 81/40* (2013.01); *E05B 81/66* (2013.01); *E05B 81/90* (2013.01); *E05B 85/02* (2013.01); *E05B 85/22* (2013.01); *E05C 5/02* (2013.01); *E05C 5/04* (2013.01); *E05B 47/023* (2013.01); *E05B 47/026* (2013.01); *E05B 63/127* (2013.01); *E05B 2047/002* (2013.01); *E05B 2047/0069* (2013.01)

(58) Field of Classification Search
CPC ..... Y10T 292/096; Y10T 292/0961; Y10T 292/0962; Y10T 292/0966; Y10T 292/1014; Y10T 292/1018; Y10T 292/1021; Y10T 292/307; Y10T 292/308; Y10T 292/492; Y10T 292/51; Y10S 292/11; Y10S 292/41; E05B 15/022; E05B 17/0025; E05B 17/0029; E05B 81/90; E05B 85/02; E05B 85/22; E05B 15/0006; E05B 81/40; E05B 81/30; E05B 81/34; E05B 81/64; E05B 81/66; E05B 81/70; E05B 83/02; E05B 83/14; E05B 47/023; E05B 47/026; E05B 47/0012; E05B 2047/0017; E05B 53/003; E05B 2047/002; E05B 2047/0069; E05B 2047/0067; E05B 53/005; E05B 2063/0026; E05B 63/125; E05B 63/127; E05B 63/128; E05B 63/244; E05B 65/001; E05B 79/20; E05B 77/34; E05B 81/06; E05B 81/18; E05B 81/20; E05B 81/22
USPC ..... 292/57, 58, 59, 137, 156, 157, 160, 138, 292/142, 144, 279, 280, 316, 327, 292/DIG. 11, DIG. 41
See application file for complete search history.

(56) References Cited

U.S. PATENT DOCUMENTS

| | | | | | |
|---|---|---|---|---|---|
| 4,568,998 | A * | 2/1986 | Kristy | G07C 9/00182 | 340/5.64 |
| 4,597,599 | A * | 7/1986 | Bisbing | E05B 15/025 | 292/174 |
| 4,744,021 | A * | 5/1988 | Kristy | G07C 9/00182 | 340/5.5 |
| 4,800,741 | A * | 1/1989 | Kerschenbaum | E05B 47/0002 | 292/1.5 |
| 5,172,945 | A * | 12/1992 | Doherty | E05B 17/0037 | 292/47 |
| 5,222,774 | A | 6/1993 | Fukumoto et al. | | |
| 5,269,161 | A * | 12/1993 | Stillwagon | E05B 5/003 | 70/208 |
| 5,467,619 | A * | 11/1995 | Stillwagon | E05B 5/003 | 292/58 |
| 5,781,399 | A * | 7/1998 | Lanigan | E05B 47/0002 | 361/172 |
| 5,802,894 | A * | 9/1998 | Jahrsetz | E05B 77/48 | 292/144 |
| 5,806,355 | A * | 9/1998 | Lanigan | E05B 47/0002 | 248/282.1 |
| 6,049,448 | A * | 4/2000 | Lanigan | E05B 47/0002 | 361/172 |
| 6,149,213 | A * | 11/2000 | Sokurenko | E05B 15/025 | 292/174 |
| 6,369,395 | B1 * | 4/2002 | Roessler | E05B 83/16 | 250/462.1 |
| 6,575,504 | B2 * | 6/2003 | Roatis | E05B 17/0029 | 292/199 |
| 6,581,986 | B2 * | 6/2003 | Roatis | E05B 17/0029 | 292/199 |
| 6,776,251 | B2 * | 8/2004 | Landmann | B60R 25/02147 | 180/287 |
| 7,073,827 | B2 * | 7/2006 | Cherry | E05B 17/0033 | 292/144 |
| 7,455,335 | B2 * | 11/2008 | Garneau | E05B 47/0012 | 292/144 |
| 7,984,936 | B2 * | 7/2011 | Lee | G06F 1/1616 | 292/150 |
| 8,494,680 | B2 * | 7/2013 | Sparenberg | F16P 7/00 | 700/275 |
| 9,404,297 | B2 * | 8/2016 | Bennett | E05C 3/08 | |
| 10,138,659 | B2 * | 11/2018 | Redondo Guerra | E05B 35/008 | |
| 10,499,527 | B2 * | 12/2019 | Liao | A47B 88/407 | |
| 2002/0060457 | A1 | 5/2002 | Roatis et al. | | |
| 2002/0083747 | A1 * | 7/2002 | Beylotte | E05B 17/0029 | 70/257 |

FOREIGN PATENT DOCUMENTS

| | | | | |
|---|---|---|---|---|
| DE | 10301998 | A1 * | 7/2004 | E05B 81/20 |
| DE | 202007014649 | U1 | 2/2009 | |
| EP | 2436864 | A1 | 4/2012 | |
| GB | 2161532 | A * | 1/1986 | E05B 17/0037 |
| GB | 2426786 | A * | 12/2006 | E05B 47/026 |
| GB | 2439477 | A * | 12/2007 | E05B 47/0012 |
| GB | 2448427 | A * | 10/2008 | E05B 47/0012 |
| WO | 2004065734 | A1 | 8/2004 | |
| WO | WO-2004065734 | A1 * | 8/2004 | E05B 81/20 |
| WO | WO-2019118201 | A1 * | 6/2019 | E05B 83/30 |

OTHER PUBLICATIONS

International Preliminary Report on Patentability and Written Opinion for International Application No. PCT/US2016/027671, dated Oct. 17, 2017, 8 pages.

Chinese Office Action with Search Report for Chinese Application No. 201680022103.5, dated Jan. 2, 2019, with translation, 14 pages.

* cited by examiner

ELECTROMECHANICAL COMPRESSION LATCH AND LATCHING SYSTEM

CROSS-REFERENCE TO RELATED APPLICATIONS

This application is a U.S. National Phase Application of PCT International Application PCT/US2016/027671, filed Apr. 15, 2016, and claims the benefit of priority of, U.S. Provisional Application No. 62/148,301, entitled ELECTROMECHANICAL COMPRESSION LATCH AND LATCHING SYSTEM, filed on 16 Apr. 2015, the contents of which are incorporated herein by reference in their entirety for all purposes.

FIELD OF THE INVENTION

The present invention relates generally to latch systems, and particularly, to latches that can be used for compressing components against one another.

BACKGROUND OF THE INVENTION

Conventionally, storage compartments for use in outdoor environments (such as those on vehicles like automobiles or boats) must be secured against the elements to prevent damage to their contents. For example, the engine compartment on a boat must be sealed in such a manner to prevent precipitation or other water from seeping into the compartment and damaging the engine.

For these types of compartments, it is important to achieve a proper seal each time the compartment is closed. This seal may be created by compressing the door of the compartment against the compartment housing to maintain an airtight environment within the compartment. However, due to the size or weight of the compartment door, weather, or other factors, it may be difficult for a user to ensure a proper seal each time the compartment is closed.

Accordingly, improved systems are desired for uses such as sealing the opening of a storage compartment. Additionally, there remains a need for improved latches and latch systems that can provide compression between the components being latched.

SUMMARY OF THE INVENTION

Aspects of the present invention are related to latches, latch assemblies, and latch systems configured to releasably compress components against one another.

In accordance with one aspect of the present invention, a latch assembly is disclosed. The latch assembly is configured to releasably compress components against one another. The latch assembly includes a latch and a receiver. The latch has a housing and a pin extending from the housing along a pin axis. The pin is mounted for longitudinal movement along the pin axis. The latch further includes a motor coupled to move the pin longitudinally. The receiver defines an aperture extending along a receiver axis and positioned to receive the pin of the latch. The receiver has a retainer biased toward the receiver axis. The latch assembly has an open position in which the pin is extended distally along the pin axis and received in the aperture. The latch assembly also has a latched position in which the pin is retracted proximally along the pin axis while the retainer is engaged with the pin.

In accordance with another aspect of the present invention, a latch system is disclosed. The latch system includes a plurality of latch assemblies as described herein. At least one of the latch assemblies has a transmitter configured to send a signal when at least one of the latch assemblies is in the open position. At least another one of the latch assemblies has a signal receiver configured to detect the signal. The latch assemblies are configured to move to the latched position after all latch assemblies are in the open position.

In accordance with yet another aspect of the present invention, a latch is disclosed. The latch is configured for use with a receiver to releasably engage components in compression relative to one another. The latch includes a housing, a pin, and a gasket. The housing defines an interior region and an aperture extending between the interior region and an exterior of the housing. The pin extends from the interior region of the housing through the aperture along a pin axis. The pin is mounted for longitudinal movement along the pin axis. The gasket is coupled to the housing. The gasket does not block the longitudinal movement of the pin and provides a seal with the pin resisting ingress of fluid from the exterior of the housing into the interior region of the housing through the aperture of the housing.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features may be arbitrarily expanded or reduced for clarity. Included in the drawings are the following figures.

DETAILED DESCRIPTION OF THE INVENTION

Figure 1:
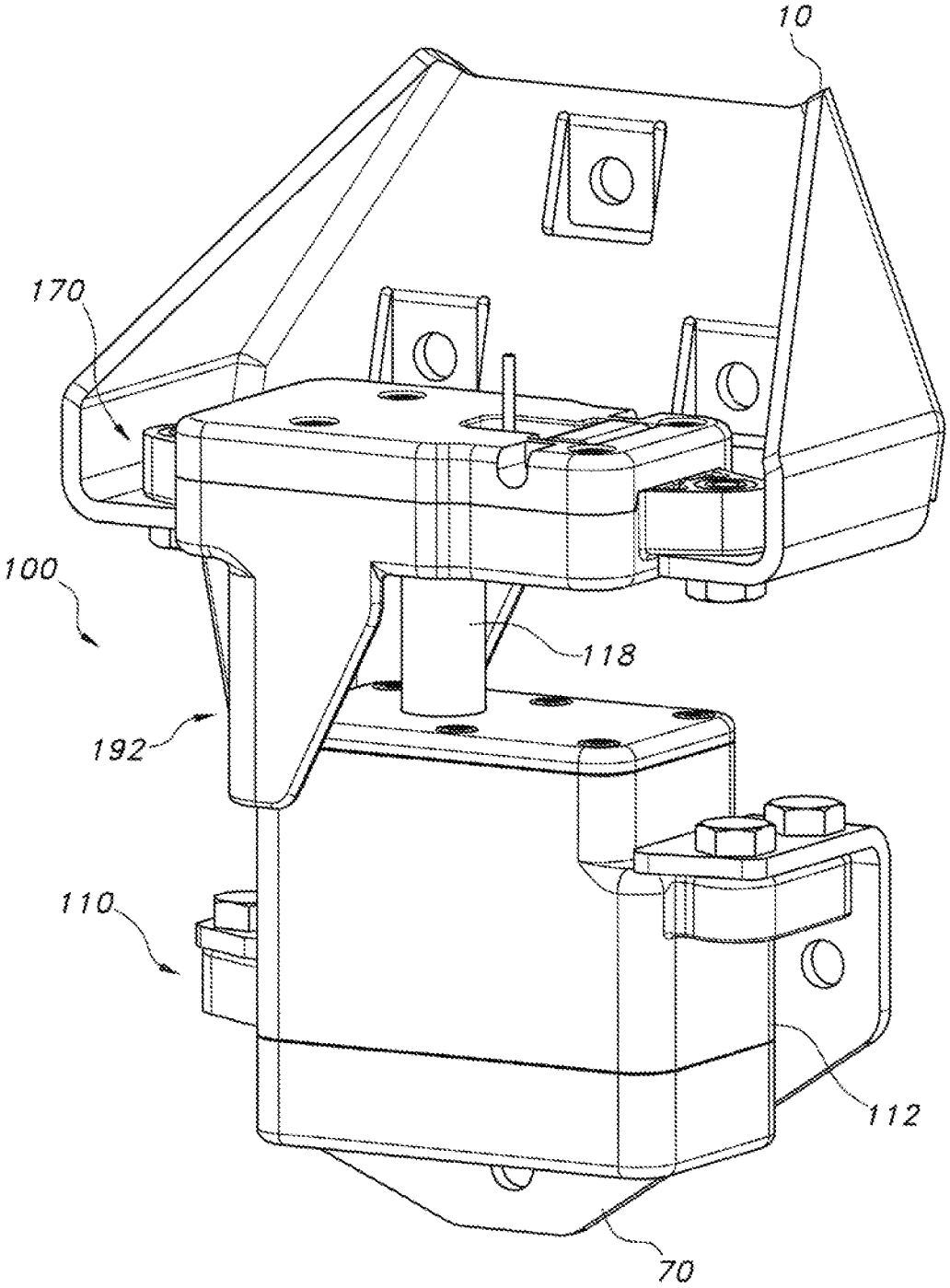
FIG. 1 depicts an exemplary latch assembly configured to releasably compress components against one another in accordance with aspects of the present invention.

Although the invention is illustrated and described herein with reference to specific embodiments, the invention is not intended to be limited to the details shown. Rather, various modifications may be made in the details within the scope and range of equivalents, of the claims and without departing from the invention.

The exemplary latch assemblies described herein provide a way of sealing storage compartments by compressing components of the compartment (e.g., the door and the compartment housing) against one another. These embodiments generally incorporate a motorized latch that is actuated when the compartment door is detected in order to directly or indirectly compress the door against the opening and seal the compartment shut. The disclosed embodiments desirably provide a reliable and easily reproducible seal to protect the contents of the compartment from exposure to the environment exterior to the compartment.

While the invention is described herein primarily with respect to outdoor vehicle compartments, it will be understood that the invention is not so limited. The disclosed latch assemblies may be usable to seal any type of storage compartment for which it is desirable to reliably and repeatably seal the compartment. Likewise, while the invention is described herein with respect to latching compartments in which environmental sealing is desired, it will be understood that the invention, is not so limited. The latch assemblies and systems disclosed herein can be used to latch any type of compartment, regardless of any particular sealing requirements of the compartment. Other exemplary storage compartments include conventional drawers, such as on medical vehicles, carts, cabinets, or containers (whether stationary or mobile), to draw in any make sure the drawer is closed. Other types of compartments are also contemplated as are other applications in which two components are to be drawn or held together.

The disclosed latch assemblies are particularly suitable for use to seal compartments against weather by compressing the door of a compartment shut. The door may be compressed directly against the housing of the compartment, or may be indirectly compressed against the compartment housing (e.g., by way of a gasket or other element designed to help maintain a seal capable of reducing or preventing the ingress of fluid into the interior of the compartment). The disclosed latch assemblies may be operable to create the compression from a predetermined open position of the door relative to the compartment, so that the door is reliably moved to a closed position.

Referring now to the drawings, FIGS. 1-8 illustrate an exemplary latch assembly 100 configured to releasably compress components against one another in accordance with aspects of the present invention. Latch assembly 100 may compress the components directly against one another, or may indirectly compress the components together via an intervening component, such as a gasket. Latch assembly 100 may be usable to create a watertight and/or airtight seal against the environment outside the interior of the compartment. As an overview, latch assembly 100 includes a latch 110 and a receiver 170. Additional details of assembly 100 are described below.

As shown in FIG. 1, latch 110 may be coupled to the compartment housing (e.g. the structure defining the walls and opening of the compartment), and receiver 170 may be coupled to the compartment door (e.g. the structure movable to open and close the opening of the compartment). Exemplary compartment housing coupling structure 10 and compartment door coupling structure 70 are illustrated in FIG. 1. Alternatively, latch 110 may be coupled to the compartment door and receiver 170 may be coupled to the compartment housing.

Figure 2A:
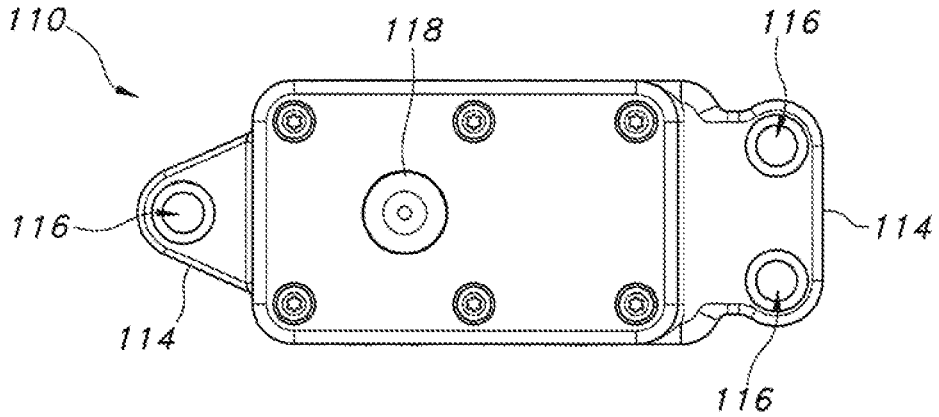
FIGS. 2A-2C depict a latch of the latch assembly of FIG. 1.
Figure 2B:
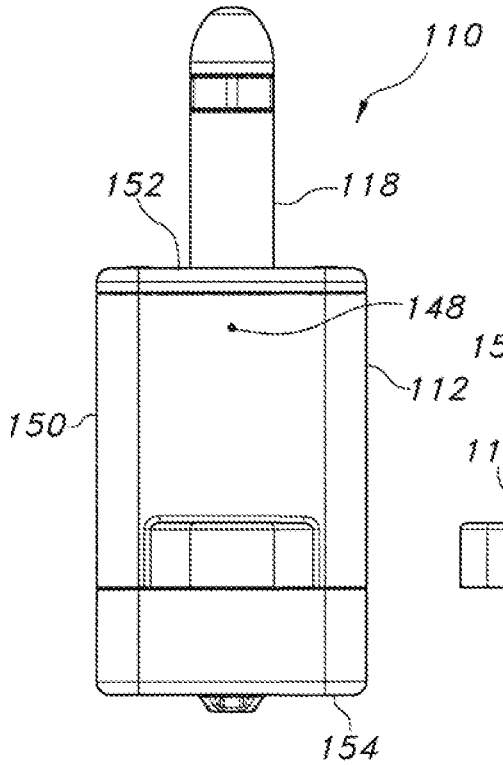
Figure 2C:
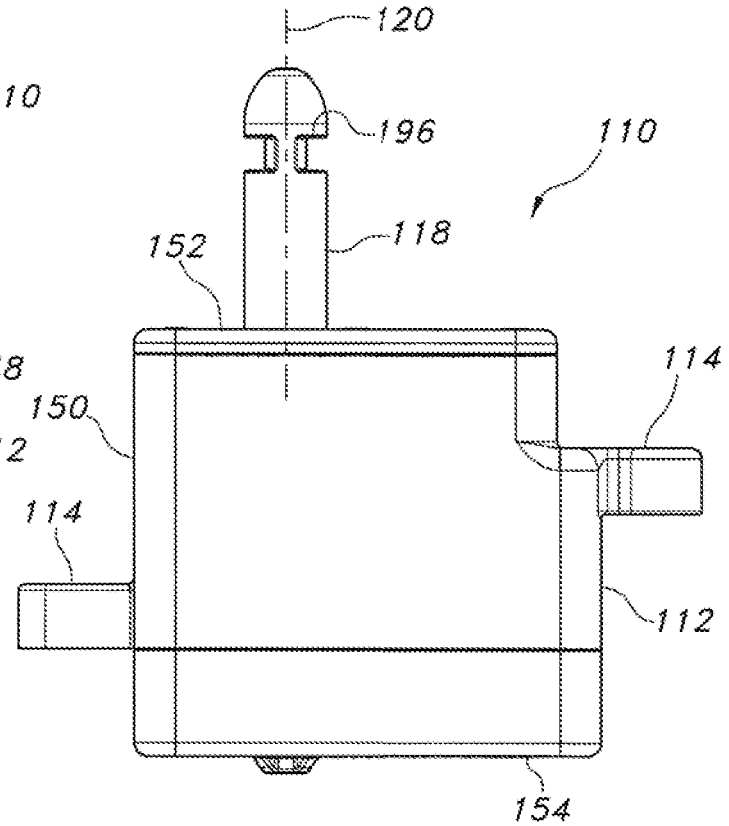

Latch 110 controls the opening and closing of the storage compartment to which latch assembly 100 is attached. As shown in FIGS. 2A-2C, latch 110 has a housing 112 which may provide a watertight or airtight seal for protecting components in an interior region of housing 112. Housing 112 further includes one or more mounting bosses 114 including mounting holes 116 for securing latch 110 to a component of the compartment, as shown in FIG. 2A. In an exemplary embodiment, housing 112 is screwed or bolted to the housing defining the compartment by way of mounting holes 116.

Latch 110 further includes a pin 118. Housing 112 includes an aperture that extends between the interior region and an exterior of housing 112 to accommodate pin 118. Pin 118 extends outward through the aperture in housing 112 along a pin axis 120, shown by a dotted line in FIG. 2C. As will be explained below with respect to the operation of latch assembly 100, pin 118 is mounted within housing 112 so as to be longitudinally movable along pin axis 120. Pin 118 may be movable between a distally extended position, shown in FIG. 4, and a proximally retracted position, shown in FIG. 5. In both positions, at least a portion of pin 118 is positioned outside of housing 112.

Latch 110 further includes a motor 122. Motor 122 is operatively coupled with pin 118, such that operation of motor 122 moves pin 118 longitudinally along pin axis 120. Latch 110 may include plurality of gears 124 for operatively coupling motor 122 to pin 118. An exemplary connection between motor 122 and pin 118 is described below with respect to FIG. 4.

In this embodiment, a first gear 124 is mounted on the shaft 126 of motor 122, and rotatably engages with a second gear 124. The second gear 124 is mounted on a gear shaft 128, to which a positional screw 130 is coaxially mounted. Accordingly, gears 124 transmit the rotational force generated by motor 122 to positional screw 130.

Positional screw 130 is threaded within a helical guide 132, which is rigidly coupled to pin 118. Rotation of positional screw 130 by motor 122 results in an upward or downward movement of helical guide 132 relative to positional screw 130. This upward or downward movement of helical guide 132 is transmitted to pin 118, with the result that pin 118 is moved upward or downward along pin axis 120 due to rotation of motor 122.

It will be understood that the above-described coupling between motor 122 and pin 118 is exemplary and not intended to be limiting. For example, a different number of gears 124 may be used, or a different mechanism for transmission of force from motor 122 to pin 118 may be used, without departing from the scope of the present invention.

Latch 110 is not limited to the above-described components, but may include alternate or additional components, as would be understood by one ordinary skill in the art from the description herein.

Figure 4:
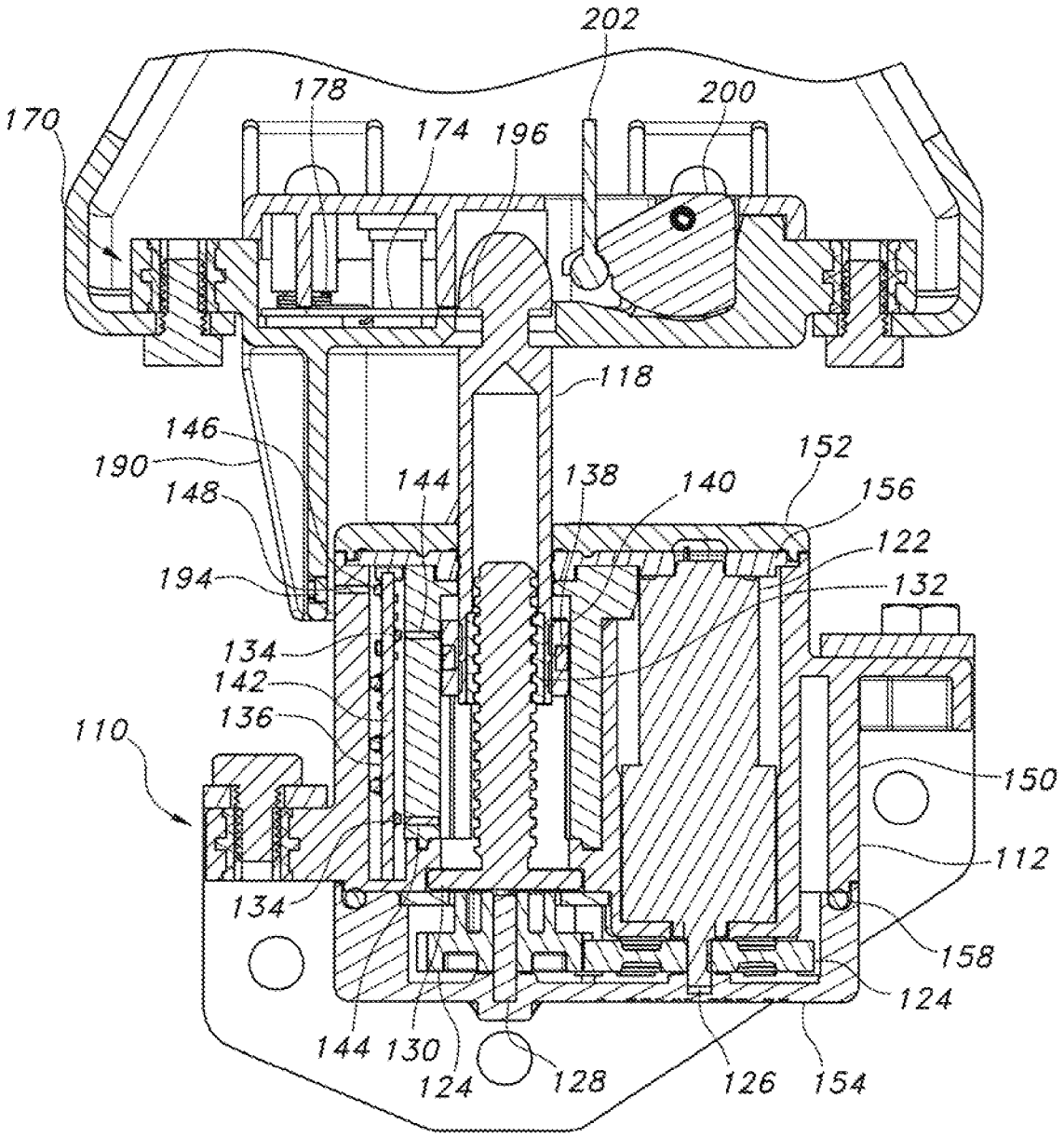
FIG. 4 depicts the latch assembly of FIG. 1 in an open position.

Latch 110 may also include a sensor 134. Sensor 134 is associated with latch 110 and operable to detect a position of pin 118 along pin axis 120. In an exemplary embodiment, sensor 134 is a Hall effect sensor, and is mounted on a circuit board 136, as shown in FIG. 4. Board 136 may include other components, such as those associated with the control and powering of motor 122. Suitable components for controlling the operation of motor 122, such as processor or inverter circuits, will be known to one of ordinary skill in the art from the description herein.

In this embodiment, latch 110 further includes at least one magnet 138. Magnet 138 is coupled to pin 118 and positioned to be detected by sensor 134 as pin 118 is moved longitudinally along pin axis 120. For example, magnet 138 may be embedded in a collar 140 surrounding pin 118. Sensor 134 may detect magnet 138 when pin 118 is extended distally along pin axis 120 from housing 112, or when pin 118 is retracted proximally along pin axis 120 into housing 112.

Figure 5:
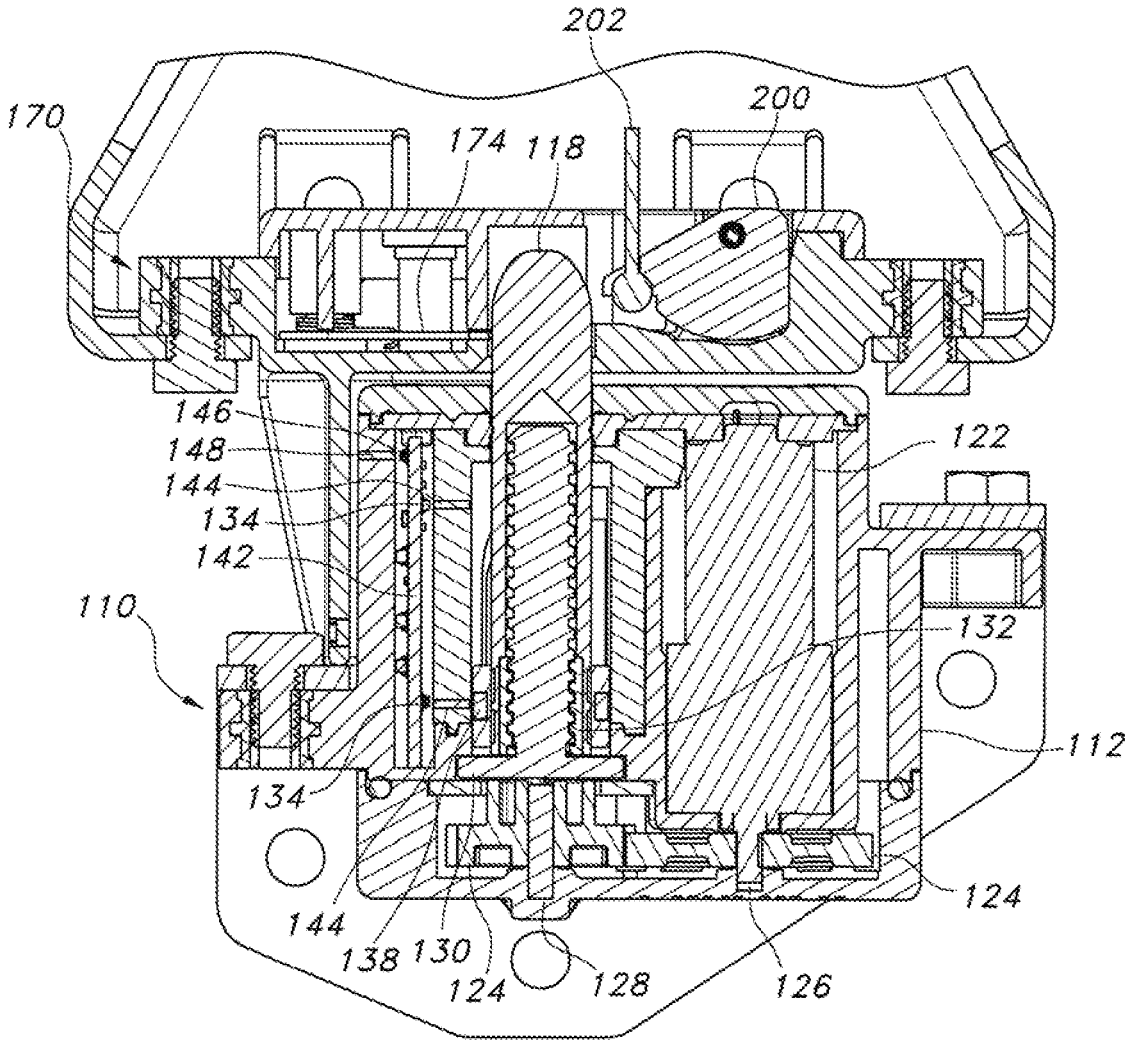
FIG. 5 depicts the latch assembly of FIG. 1 in a latched position.
Figure 6:
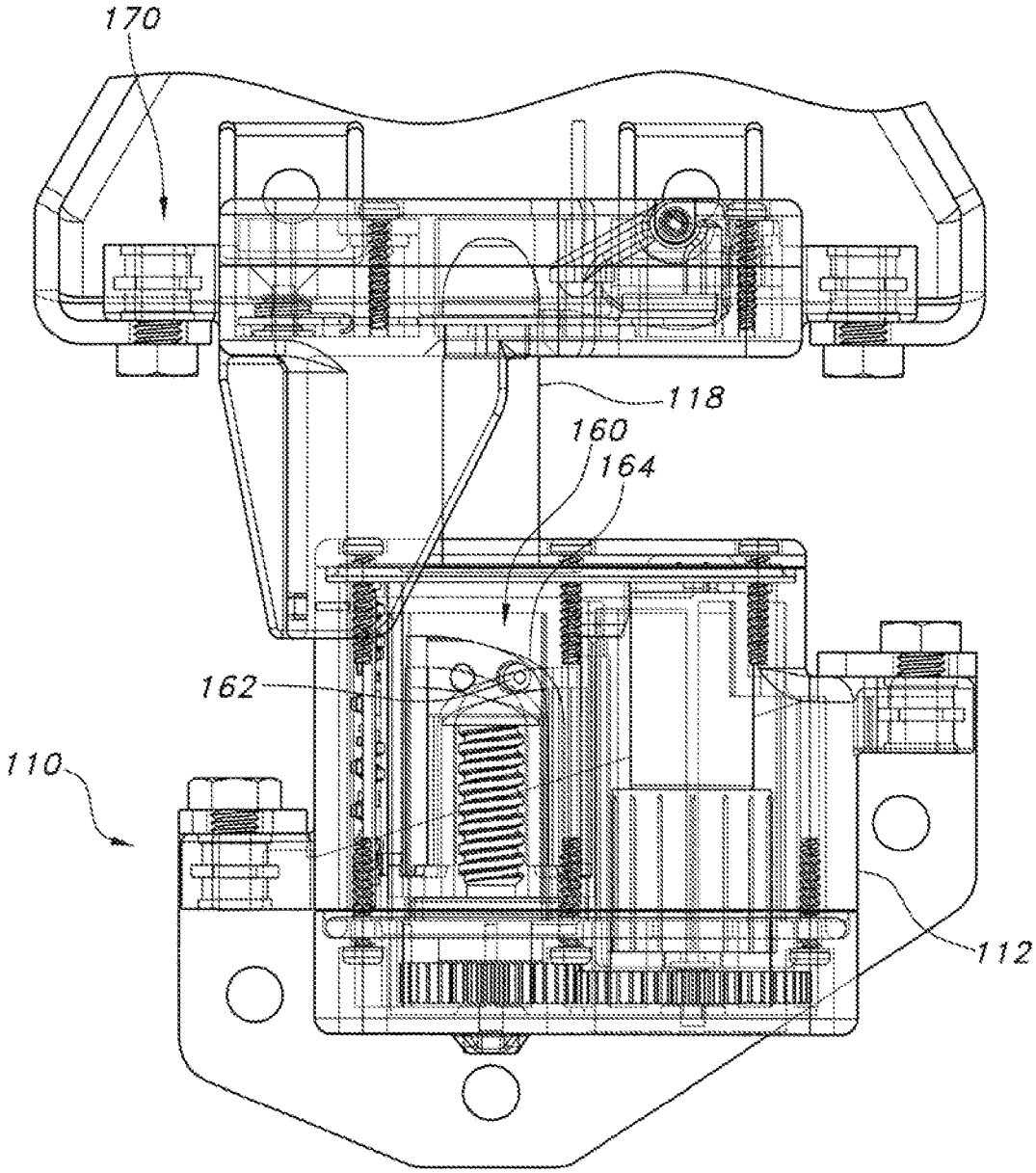
FIG. 6 depicts another view of the latch assembly of FIG. 1, revealing a guide.

In a further embodiment, latch 110 includes multiple sensors 134. An upper sensor 134 is positioned to detect magnet 138 when pin 118 is extend distally along pin axis 120, and a lower sensor 134 is positioned to detect magnet 138 when pin 118 is retracted proximally along pin axis 120, as shown in FIGS. 4 and 5. While these embodiments are described herein with respect to magnet 138 being coupled to pin 118 and sensors 134 being stationary within housing 112, it will be understood that the invention is not so limited, and that in other embodiments, a sensor 134 may be coupled to pin 118 with multiple magnets 138 being stationary within housing 112.

Latch 110 may also include one or more components designed to improve the accuracy of detection of the position of pin 118. In an exemplary embodiment, latch 110 comprises a barrier 142 positioned between sensors 134 and magnet 138. Barrier 142 may be configured, for example, as a cylinder surrounding pin 118, or as a wall positioned adjacent circuit board 136 on one side of pin 118. In a further exemplary embodiment, barrier 142 is part of guide 160, described below.

Barrier 142 is formed from a material that fully or partially blocks magnetic flux from magnet 138 to sensors 134. Suitable materials for forming barrier 142 will be known to one of ordinary skill in the art from the description herein.

Barrier 142 composes a flux pipe 144 positioned adjacent each sensor 134 on circuit board 136. Flux pipes 144 are openings in barrier 142 through which magnetic flux from magnet 138 may be communicated to sensors 134. By controlling the size and positioning of flux pipes 144, the accuracy of sensors 134 in detecting the position of pin 118 may be improved. Additionally, because flux pipes 144 are only positioned adjacent sensors 134 at the distally extended and proximally retracted positions in this embodiment, magnet 138 is not sensed by sensors 134 during movement between these positions.

In addition to sensing a position of pin 118, latch 110 may include a sensor 146 for sensing a position of receiver 170. Sensor 146 is associated with latch 110 and operable to detect the presence of receiver 170, e.g., when latch assembly 100 is in the open position. In an exemplary embodiment, sensor 146 is also a Hall effect sensor, and is mounted on an opposite surface of circuit board 136 as sensors 134.

In this embodiment, latch 110 includes another barrier positioned between sensor 146 and receiver 170. This other barrier may be formed by the wall of housing 112, as shown in FIG. 4. As with barrier 142, the wall of housing 112 may be formed from a material that fully or partially blocks magnetic flux from receiver 170 to sensor 146. Likewise, the wall of housing 112 may comprise a flux pipe 148 positioned adjacent sensor 146 for allowing magnetic flux from receiver 170 to be communicated to sensor 146.

While these embodiments are described herein with respect to a magnet being coupled to receiver 170 and sensor 146 being coupled to latch 110, it will be understood that the invention is not so limited, and that in other embodiments, a sensor 146 may be coupled to receiver 170 with a magnet being coupled to latch 110.

Instead of magnetic sensors as set forth above, it will be understood that other sensors could be used to detect the position of pin 118 or receiver 170. For example, sensors 134 may be infrared or light sensors configured to detect a change in a light path when pin 118 or receiver 170 are in a predetermined position. For another example, mechanical switches may be used to determine when pin 118 or receiver 170 are in a predetermined position. Other suitable sensors for use with latch assembly 100 will be known to one of ordinary skill in the art from the description herein.

As set forth above, latch 110 includes a housing 112 accommodating the components therein. In one embodiment, housing 112 may have a single piece design in order to provide a watertight and/or airtight seal from the surrounding environment. In an alternative embodiment, housing 112 may be formed from multiple components, as shown in FIGS. 2B and 2C. In this embodiment, housing 112 comprises a wall portion 150, an upper endcap 152, and a lower endcap 154. Upper endcap 152 is coupled to wall portion 150 via an upper sealing gasket 156, and lower endcap 154 is coupled to wall portion 150 via a lower sealing gasket 158.

Upper sealing gasket 156 is shaped to accommodate the components of latch 110, including a through-hole to enable pin 118 to extend out of housing 112. Upper sealing gasket 156 does not block the longitudinal movement of pin 118 described above, while providing a seal with pin 118 to protect against ingress of fluid from the exterior of housing 112 into the interior region of housing 112. To this end, in this embodiment, the through-hole in upper sealing gasket 156 has a diameter no larger than an external diameter of pin 118, in order to maintain contact between upper sealing gasket 156 and pin 118 during the longitudinal movement of pin 118 along pin axis 120. Lower sealing gasket 158 may be formed, for example, as an O-ring, as shown in FIG. 4.

In additional to moving longitudinally, pin 118 may further be mounted for rotational movement about pin axis 120 in latch 110. Such rotational movement may occur during the longitudinal movement of pin 118 along pin axis 120. An exemplary rotation of pin 118 is described below with respect to FIG. 6.

In an exemplary embodiment, latch 110 comprises a guide 160. Guide 160 causes rotational movement of pin 118 during the longitudinal movement of pin 118 along pin axis 120. To this end, guide 160 may have a cylindrical or partially cylindrical shape so as to surround at least a portion of pin 118.

Pin 118 and guide 160 interact via a mating engagement. In this engagement, pin 118 includes a post 162 extending transversely relative to pin axis 120. Guide 160 surrounds pin 118 and includes a slot 164 positioned to receive the post. Slot 164 curves toward the top of guide 160, so as to have an approximate upside-down a-shape. As pin 118 is moved along the pin axis from the proximally retracted position toward the distally extended position, post 162 rides in the straight portion of slot 164. When post 162 reaches and rides in the curved portion of slot 164 (shown by arrow in FIG. 6), pin 118 is rotated around pin axis 120. Guide 160 may be configured to rotate pin 118 approximately 90 degrees between the proximally retracted position and the distally extended position. This rotation is used to attach latch 110 onto receiver 170, as will be discussed below.

While the above embodiment is described with respect to post 162 being coupled to pin 118 and slot 164 being formed in guide 160, it will be understood that the invention is not so limited, and that in other embodiments, post 162 may be coupled to guide 160, and slot 164 may be formed in pin 118.

Receiver 170 mates with latch 110. As shown in FIG. 3D, receiver 170 defines an aperture 172 shaped to accommodate pin 118 of latch 110. Aperture 172 extends along a receiver axis into the body of receiver 170. When receiver 170 is mated with latch 110, aperture 172 is positioned to receive pin 118.

Receiver 170 includes a retainer 174 biased toward the receiver axis defined by aperture 172. Retainer 174 is shaped to engage, with a corresponding portion of pin 118 in order to attach receiver 170 to latch 110.

Figure 7A:
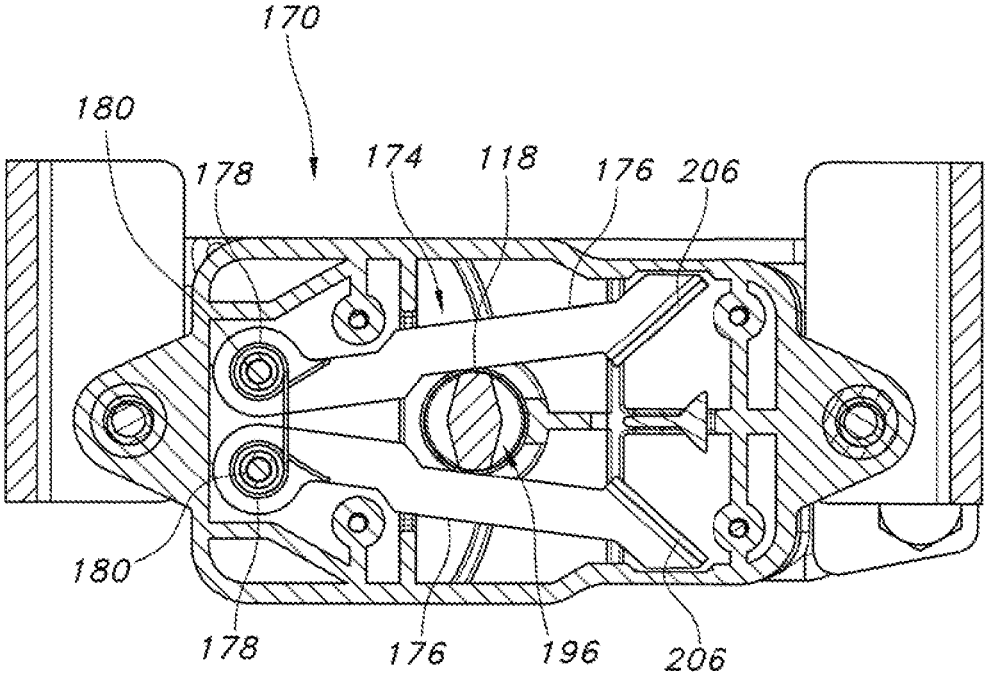
FIGS. 7A-7D depict the operation of a retainer of the latch assembly of FIG. 1.

In an exemplary embodiment, retainer 174 comprises a pair of retention blades 176, shown in FIGS. 7A-7D. Retention blades 176 are rotatably mounted on pins 180, and are biased toward the axis of aperture 172 by respective springs 178. When pin 118 is fully inserted into aperture 172, retention blades 176 contact the outside of pin 118, as shown in FIG. 7A.

While retention blades 176 are described herein as being rotatable to engage pin 118, it will be understood that the invention is not so limited. For example, one or more retainer components such as, retention blades 176 may be slidable or otherwise repositionable in order to move between a disengaged and an engaged position, relative to pin 118. Alternatively, the retainer may be a component having an aperture for receiving the pin 118, the component being mounted and biased to engage the pin but movable to release the pin 118. Additional detail regarding the engagement of retainer 174 to pin 118 are provided below with respect to the operation of latch assembly 100.

Receiver 170 is not limited to the above-described components, but may include alternate or additional components, as would be understood by one of ordinary skill in the art from the description herein.

Figure 3A:
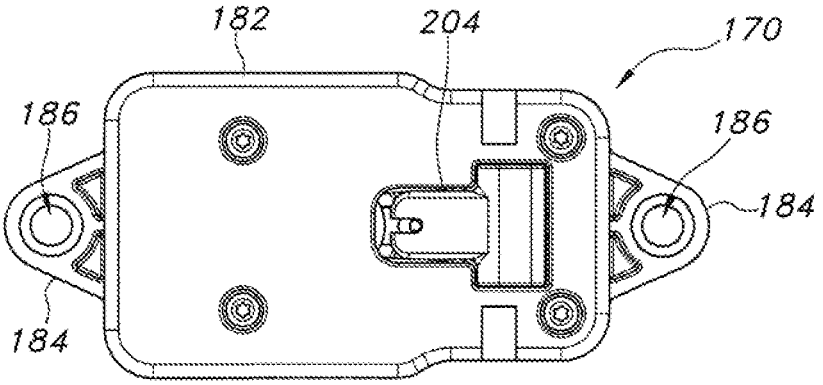
FIGS. 3A-3D depict a receiver of the latch assembly of FIG. 1.
Figure 3C:
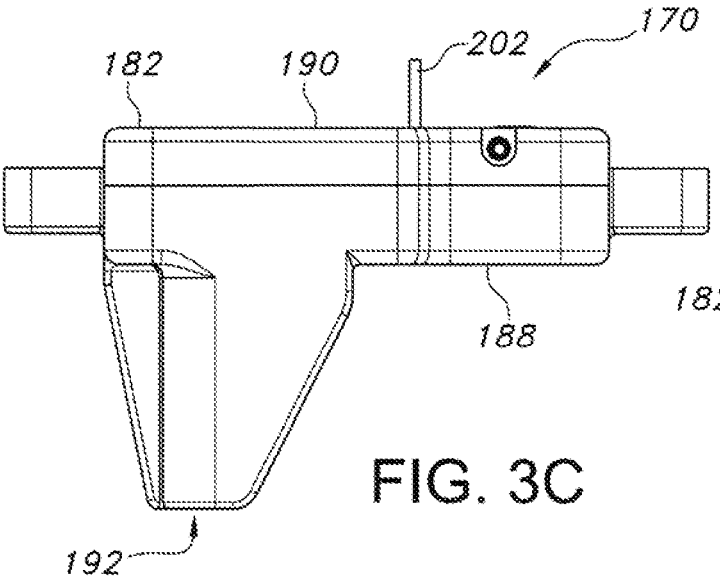
Figure 3B:
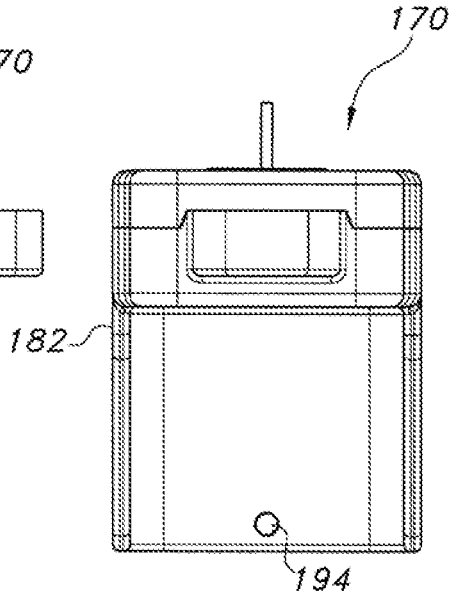
Figure 3D:
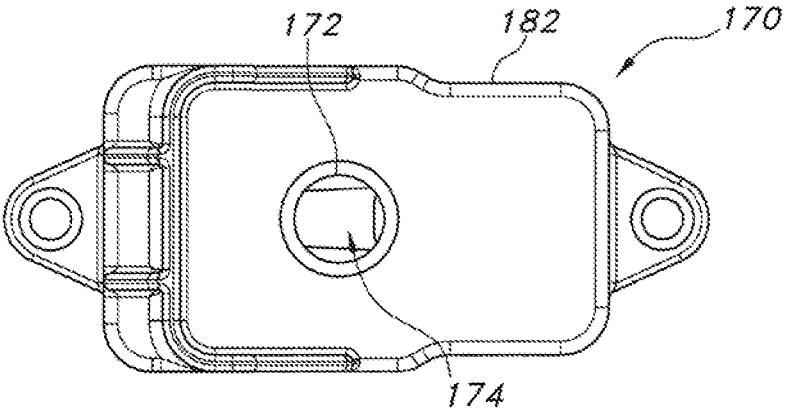

Receiver 170 may further include a housing 182, as shown in FIGS. 3A-3D. Housing 182 may provide a watertight or airtight seal for protecting components in an interior region of housing 182. Housing 182 defines the aperture 172 for receiving pin 118 of latch 110. Like housing 112, housing 182 includes one or more mounting bosses 184 including mounting holes 186 for securing receiver to a component of the compartment, as shown in FIG. 3A. In an exemplary embodiment, housing 182 is screwed or bolted to the compartment door by way of mounting holes 186.

In one embodiment, housing 182 may have a single piece design in order to provide a watertight and/or airtight seal from the surrounding environment. In an alternative embodiment, housing 182 may be formed from multiple components, as shown in FIG. 3C. In this embodiment, housing 182 comprises a wall portion 188 and an upper endcap 190. Upper endcap 190 may be coupled to wall portion 188 via a sealing gasket.

Housing 182 of receiver 170 may include one or more alignment surfaces 192. Alignment surfaces extend downwardly from the body of housing 182, as shown in FIGS. 1 and 3C. Alignment surfaces 192 are positioned to contact housing 112 of latch 110 when latch assembly 100 is in the open position. Alignment surfaces 192 are positioned to align pin axis 120 with the receiver axis defined by aperture 172, in order to ensure proper attachment of receiver 170 to latch 110. In an exemplary embodiment, alignment surfaces contact multiple (e.g., three) different sides of latch 110 in order to create the desired alignment.

As set forth above, latch 110 may include a sensor 146 for sensing a position of receiver 170. In this exemplary embodiment, receiver 170 includes a magnet 194 for detection by Hall effect sensor 146. Magnet 194 is positioned to be detected by sensor 146 when latch assembly 100 is in the open position, e.g., when pin 118 is extended distally along pin axis 120 and is received within aperture 172. Magnet 194 may be mounted in a wall of one of the alignment surfaces 192, as shown in FIGS. 3B and 4.

As set forth above, retainer 174 engages pin 118 to hold it in place within aperture 172. To effect this engagement, pin 118 may include an engagement surface 196 formed on the distal end thereof. Engagement surface 196 extends transversely to pin axis 120. Retainer 174 is positioned to contact engagement surface 196 of pin 118 when pin 118 begins to retract from aperture 172.

In an exemplary embodiment, engagement surface 196 may be formed by a pair of undercuts in pin 118, as best shown in FIG. 7A. Retention blades 176 are biased by a spring 178 (shown in FIG. 4) to move into respective undercuts to contact the upper and/or lower surfaces of the undercuts when pin 118 is inserted into aperture 172. This contact between retention blades 176 and engagement surface 196 is maintained when pin 118 is retracted proximally into housing 112 of latch 110. This results in compression of receiver 170 against latch 110.

During compression of the compartment door against the compartment housing (e.g., to seal the opening of the compartment), latch assembly 100 has two positions, referred to herein as an open position (shown in FIG. 4) and a latched position (shown in FIG. 5). The features of each position are described below.

In the open position, pin 118 is extended distally along pin axis 120 from housing 112, such that pin 118 is received in aperture 172 of receiver 170, as shown in FIG. 4. Pin 118 is desirably inserted into aperture 172 up until the uppermost end of pin 118 contacts an upper surface of aperture 172.

Latch assembly 100 may detect that it is in the open position when sensor 146 detects the presence of magnet 194. Power to motor 122 may be automatically turned on when latch assembly 100 detects that it is in the open position to (e.g., that receiver 170 is present), to begin a latching operation of latch assembly 100.

When pin 118 is in the distally extended position, it is rotated 90 degrees by guide 160, as described above. As shown in FIG. 7A, the rotation of pin 118 moves the undercuts that form engagement surface 196 to be orthogonal to retention blades 176. Accordingly, when pin 118 is distally extended, retention blades 176 contact the outer edge of pin 118, and cannot engage with engagement surface 196 on pin 118. This enables receiver 170 to be removed from latch 110 without manipulation or operation of either component.

Figure 7B:
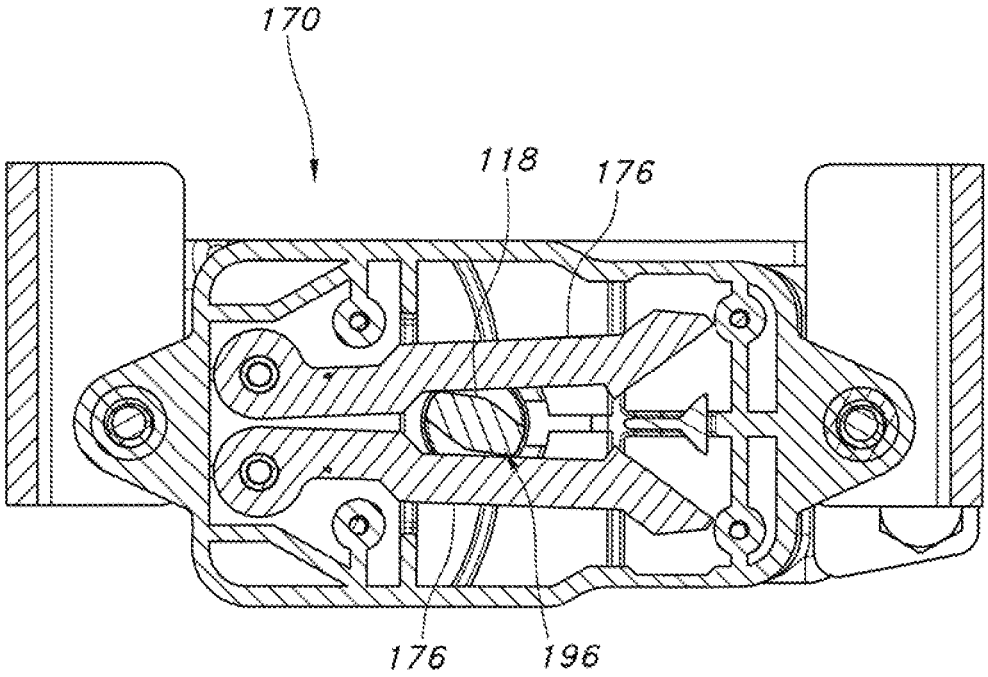

As pin 118 begins to be retracted by motor 122, pin 118 begins to rotate due to the shape of guide 160. During this retraction, receiver 170 remains in contact with latch 110 due, e.g., to the force of gravity on the compartment door (and corresponding force on receiver 170). As the rotation of pin 118 continues, retention blades 176 begin to move into the undercuts that form engagement surface 196 due to the force of the spring(s) on retention blades 176, as shown in FIG. 7B. This movement creates an engagement between retainer 174 and pin 118, which holds receiver 170 to latch 110 during retraction of pin 118.

Figure 7C:
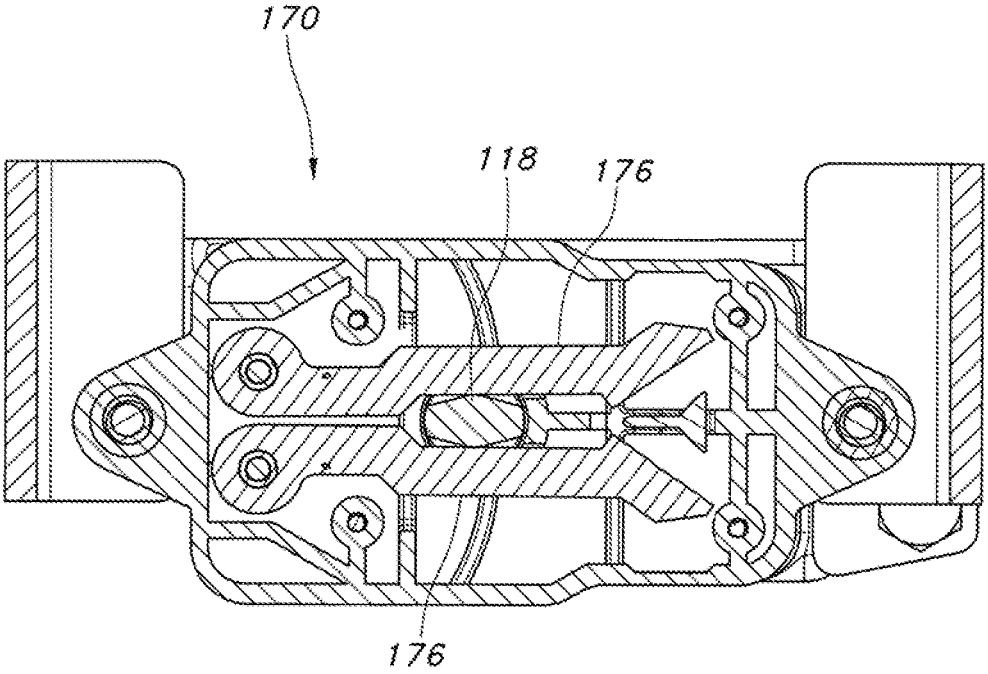
Figure 7D:
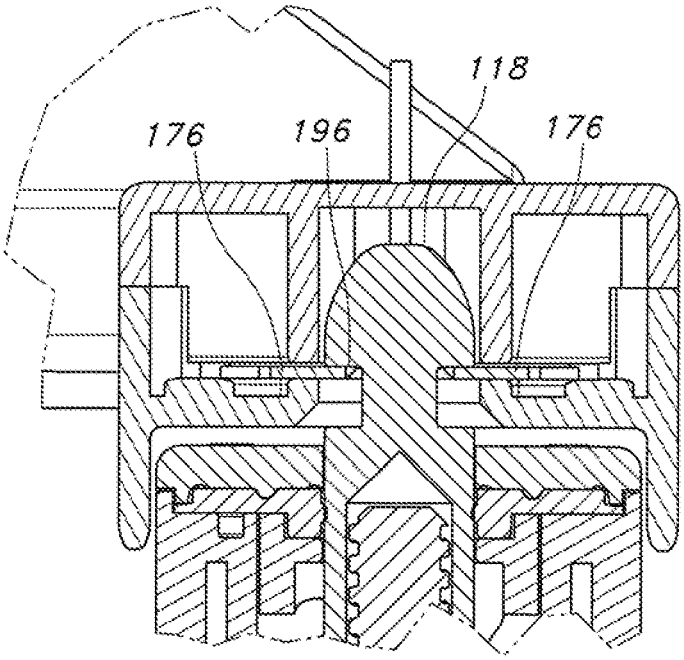

In the latched position, pin 118 is retracted proximally along pin axis 120 into housing 112. This retraction occurs while retainer 174 is engaged with pin 118. During this retraction, the rotation of pin 118 is completed, such that the undercuts defining engagement surface 196 face retention blades 176. This allows retention blades 176 to be fully moved into the undercuts, as shown in FIGS. 7C and 7D, thus securing the engagement between retainer 174 and pin 118, in the latched position, receiver 170 is compressed directly or indirectly against latch 110, with the force of the compression being created by the engagement between retainer 174 and pin 118.

The full, amount of retraction of pin 118 following engagement with retainer 174 is set to achieve a desired level of compression of the components of the compartment. In other words, the length of travel of pin 118 from the distally extended position to the proximally retracted position should correspond to the amount of force desired for sealing the compartment. In a preferred embodiment, pin 118 has a travel distance of at least approximately ¾ inch (19 mm) between the open position (once the pin 118 is inserted into aperture 172) and the latched position. This distance may enable a compressive loading of at least approximately 15 lbs. for a single latch assembly 100.

Latch assembly 100 may detect that it is in the latched position when the lower sensor 134 detects the presence of magnet 138 via the lower flux pipe 144. Power to motor 122 may be automatically turned off when latch assembly 100 detects that it is in the latched position.

Figure 8:
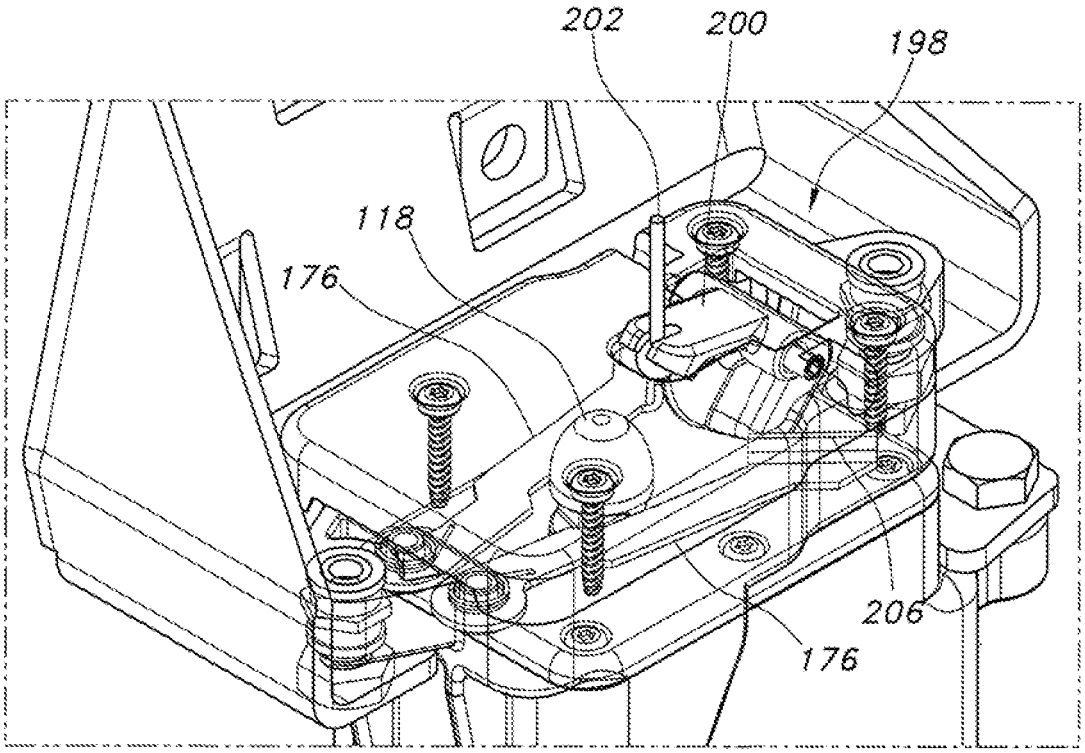
FIG. 8 depicts another view of the latch assembly of FIG. 1, revealing a release mechanism.

Receiver 170 may also include a release mechanism 198, as shown in FIG. 8. Release mechanism 198 is configured to disengage retainer 174 from pin 118. Release mechanism 198 may be configured to disengage receiver 170 from latch 110 in situations where the automatic disengaging operation is net functioning properly for any reason or is otherwise intentionally disabled.

In an exemplary embodiment, release mechanism 198 includes an arm 200 positioned within housing 182 of receiver 170. Arm 200 contacts retainer 174 such that movement of arm 200 moves retainer 174 away from the receiver axis defined by aperture 172, thus disengaging retainer 174 from pin 118.

In a further exemplary embodiment, arm 200 is actuated by a cable 202. Cable 202 extends outward from housing 182 of receiver 170 through another aperture 204, as shown in FIG. 3A, in order to be grasped or pulled by a user. Cable 202 may be coupled to arm 200, e.g., by positioning through a slot or through-hole in arm 200. When cable 202 is pulled, arm 200 is rotated around an axis within receiver 170. As arm 200 rotates, it presses against surfaces 206 on retention blades 176. Surfaces 206 are shaped such that, when pressed by arm 200, retention blades 176 are forced outward and away from the axis defined by aperture 172. Accordingly, when cable 202 is pulled, retention blades 176 are disengaged from pin 118, and receiver 170 may be separated from latch 110.

Figure 9:
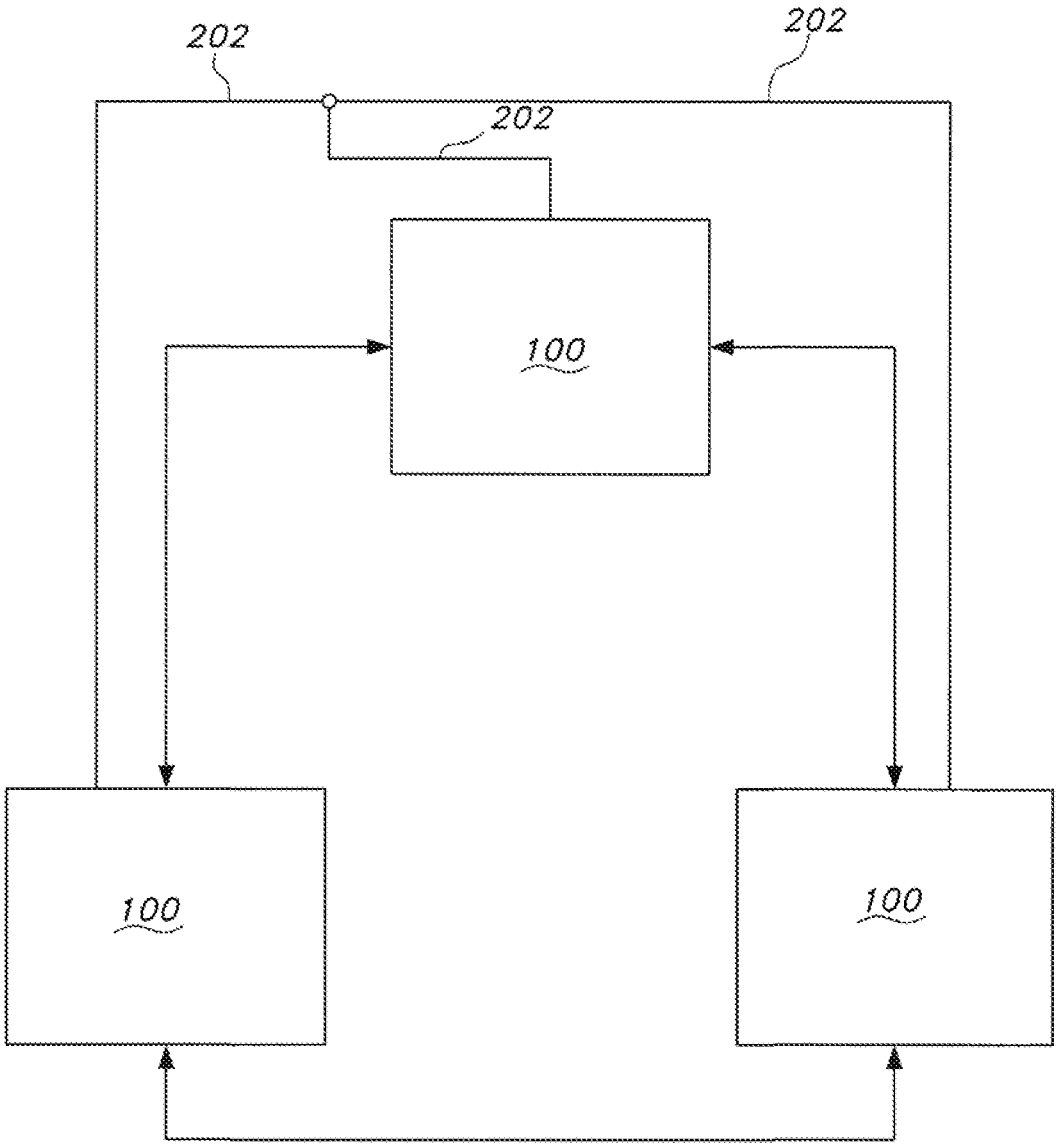
FIG. 9 depicts an exemplary latch system in accordance with aspects of the present invention.

In some embodiments, multiple latch assemblies 100 may be used to secure a single compartment as part of a latch system. An exemplary latch system comprising multiple latch assemblies 100 is shown in FIG. 9. In this embodiment, each latch assembly 100 includes a latch coupled to one of the compartment housing and the compartment door, and a receiver coupled to the other one of the compartment housing and the compartment door.

In these embodiments, at least one of the latch assemblies 100 includes a transmitter. The transmitter may be mounted on the circuit board of the associated latch assembly 100. The transmitter is configured to send a signal to one or more of the other latch assemblies 100 when its associated latch assembly 100 is in the open position (shown in FIG. 4).

At least one of the latch assemblies 100 has a signal receiver. The signal receiver may also be mounted on the circuit board of the associated latch assembly 100. The signal receiver is configured to detect the signal transmitted from another latch assembly 100.

Signals may be transmitted between latch assemblies 100 by wire in the compartment door or compartment housing. Alternatively, latch assemblies 100 may include wireless transmitters or receivers for transmitting signals therebetween. Examiner communication paths between the latch assemblies 100 is illustrated by arrows in FIG. 9. Suitable transmitters or signal receivers for use in communicating between latch assemblies 100 will be known to one of ordinary skill in the art from the description herein.

In this embodiment, the control circuits of latch assemblies 100 are configured to operate to seal the compartment in concert. As such, latch assemblies 100 are configured to move the receiver to the latched position (shown in FIG. 5) only after all latch assemblies 100 transmit the signal that they are in the open position (shown in FIG. 4). In one example, one latch assembly 100 may act as a master, and may broadcast a signal to the remaining latch assemblies to move the receiver once it receives a signal that each latch assembly 100 is in the open position. In another example, each latch assembly 100 may be configured to move the receiver once it receives a signal that each latch assembly 100 is in the open position.

A preferred exemplary embodiment of the operation of a latch system is described below. When latching according to this embodiment, each latch assembly in the system is configured to actuate and respond independently of the remaining latches. In particular, each latch assembly responds upon detecting the presence of its respective receiver. This response may include transmitting a signal on a status line connecting each latch (e.g., an indication that the respective latch assembly is in the open position). In an exemplary embodiment, the status line is represented by bi-directional arrows between latch assemblies 100 in FIG. 9.

When each latch assembly has broadcast such a status signal to indicate to the remaining latch assemblies that it is in the open position, all latch assemblies of the system are configured to begin actuating to move to the latched position. During a releasing operation, all latch assemblies will receive the same signal via a command line (which may be different from or the same as the status line set forth above). Each latch assembly will then filter the actuation signal and then commence unlatching.

Where multiple latch assemblies 100 are used, the cables 202 from each assembly 100 may be joined or grouped together, as shown in FIG. 9. Connecting cables 202 from each latch assembly desirably allows a single pull to mechanically release all latch assemblies 100.

While preferred embodiments of the invention have been shown and described herein, it will be understood that such embodiments are provided by way of example only. Numerous variations, changes and substitutions will occur to those skilled in the art without departing from the spirit of the invention. Accordingly, is intended that the appended claims cover all such variations as fall within the spirit and scope of the invention.

What is claimed:

1. A latch assembly configured to releasably compress components against one another, the latch assembly comprising:

a latch having a housing, a pin extending from the housing along a pin axis and mounted for longitudinal movement along the pin axis, and a motor coupled to move the pin longitudinally;

a Hall effect sensor associated with the latch for detecting a position of the pin along the pin axis;

a magnet coupled to the pin and positioned to be detected by the sensor when the pin is extended distally along the pin axis or retracted proximally along the pin axis;

a barrier positioned between the sensor and the magnet, the barrier comprising a flux pipe through which magnetic flux from the magnet is communicated to the sensor;

a receiver defining an aperture extending along a receiver axis and positioned to receive the pin of the latch, the receiver having a retainer biased toward the receiver axis; and an additional sensor associated with the latch for detecting a presence of the receiver, the Hall effect sensor and the additional sensor being co-located on a common circuit board;

the latch assembly having an open position in which the pin is extended distally along the pin axis and received in the aperture of the receiver; and the latch assembly also having a latched position in which the pin is retracted proximally along the pin axis and the retainer is engaged with the pin to block removal of the pin from the aperture, wherein the Hall effect sensor and the additional sensor are mounted on opposite sides of the common circuit board.

2. The latch assembly of claim 1, wherein the additional sensor comprises a Hall effect sensor, and further comprising:

an additional magnet coupled to the receiver and positioned to be detected by the additional sensor when the latch assembly is in the open position.

3. The latch assembly of claim 2, further comprising an additional barrier positioned between the additional sensor and the additional magnet, the additional barrier comprising a flux pipe through which magnetic flux from the magnet is communicated to the sensor.

4. The latch assembly of claim 1, wherein the pin is further mounted for rotational movement about the pin axis during the longitudinal movement of the pin.

5. The latch assembly of claim 4, the latch further comprising a guide positioned to cause the rotational movement of the pin during the longitudinal movement of the pin along the pin axis.

6. The latch assembly of claim 5, wherein one of the pin and the guide comprises one of a post extending transversely relative to the pin axis and a slot positioned to receive the post, and the other one of the pin and the guide comprises the other one of the post and the slot.

7. The latch assembly of claim 6, wherein the post is coupled to the pin and the slot is defined by the guide.

8. The latch assembly of claim 1, wherein the pin defines an engagement surface extending transversely to the pin axis, the retainer being movable to contact the engagement surface of the pin when the pin is received in the aperture defined by the receiver and retracted proximally along the pin axis.

9. The latch assembly of claim 8, wherein the engagement surface of the pin is released from contact with the retainer by rotation of the pin when the pin is extended distally along the pin axis.

10. The latch assembly of claim 1, the receiver further comprising a release mechanism configured to disengage the retainer from the pin.

11. The latch assembly of claim 10, wherein the release mechanism comprises an arm configured to move the retainer away from the receiver axis to disengage the retainer from the pin.

12. The latch assembly of claim 11, wherein the release mechanism further comprises a cable extending outward from the receiver, the cable coupled to the arm such that pulling the cable causes the arm to move the retainer away from the receiver axis.

13. The latch assembly of claim 1, the receiver further comprising one or more alignment surfaces positioned to contact the housing of the latch when the latch assembly is in the open position, the one or more alignment surfaces configured to align the pin axis with the receiver axis.

14. A latch system including a plurality of latch assemblies, each of the plurality of latch assemblies comprising:

a latch having a housing, a pin extending from the housing along a pin axis and mounted for longitudinal movement along the pin axis, and a motor coupled to move the pin longitudinally; and a receiver defining an aperture extending along a receiver axis and positioned to receive the pin of the latch, the receiver having a retainer biased toward the receiver axis;

the latch assembly having an open position in which the pin is extended distally along the pin axis and received in the aperture of the receiver; and the latch assembly also having a latched position in which the pin is retracted proximally along the pin axis and the retainer is engaged with the pin to block removal of the pin from the aperture, wherein each of the plurality of latch assemblies has a control circuit in communication with a transmitter and a signal receiver, the control circuit of each of the plurality of latch assemblies sending a signal with the transmitter when a latch assembly of the control circuit is in the open position, and the control circuit of each of the plurality of latch assemblies moving the latch assembly of the control circuit to the latched position only after all of the plurality of latch assemblies are in the open position.

15. A latch configured for use with a receiver to releasably compress components against one another, the latch comprising:

a housing defining an interior region and an aperture extending between the interior region and an exterior of the housing;

a pin extending from the interior region of the housing through the aperture along a pin axis, the pin being mounted for longitudinal movement along the pin axis;

a Hall effect sensor for detecting a position of the pin along the pin axis;

an additional sensor associated with the latch for detecting a presence of the receiver, the Hall effect sensor and the additional sensor being co-located on a common circuit board;

a magnet coupled to the pin and positioned to be detected by the sensor when the pin is extended distally along the pin axis or retracted proximally along the pin axis;

a barrier positioned between the sensor and the magnet, the barrier comprising a flux pipe through which magnetic flux from the magnet is communicated to the sensor; and a gasket coupled to the housing, the gasket not blocking the longitudinal movement of the pin and providing a seal with the pin resisting ingress of fluid from the exterior of the housing into the interior region of the housing through the aperture of the housing, wherein the Hall effect sensor and the additional sensor are mounted on opposite sides of the common circuit board.

16. The latch of claim 15, the gasket having a through-hole through which the pin extends, the gasket through-hole having a diameter no larger than an external diameter of the pin.

* * * * *